United States Patent [19]

Miyazaki et al.

[11] Patent Number: 4,938,195

[45] Date of Patent: Jul. 3, 1990

[54] ATMOSPHERIC PRESSURE DETECTING DEVICE FOR ENGINE CONTROL

[75] Inventors: Masaaki Miyazaki; Shinji Kojima; Hajime Kako, all of Himeji, Japan

[73] Assignee: Mitsubishi Denki Kabushiki Kaisha, Tokyo, Japan

[21] Appl. No.: 346,677

[22] Filed: May 3, 1989

[30] Foreign Application Priority Data

May 6, 1988 [JP] Japan ..... 63-111222

[51] Int. Cl.[5] ..... F02D 35/00

[52] U.S. Cl. ..... 123/488; 73/115; 123/494

[58] Field of Search ..... 123/339, 478, 480, 488, 123/491, 494; 73/115, 116, 117.3

[56] References Cited

U.S. PATENT DOCUMENTS

| | | | |
|---|---|---|---|
| 3,931,808 | 1/1976 | Rachel . | |
| 4,131,088 | 12/1978 | Reddy | 123/494 |
| 4,165,650 | 8/1979 | Weissler, II | 73/115 X |
| 4,388,825 | 6/1983 | de Valpillieres | 73/115 |
| 4,416,239 | 11/1983 | Takase et al. | 123/494 X |
| 4,475,381 | 10/1984 | Nakatami et al. | 73/115 |
| 4,590,563 | 5/1986 | Matsumura et al. | 123/488 X |
| 4,600,993 | 7/1986 | Pauwels et al. | 123/488 X |
| 4,787,043 | 11/1988 | Zimmerman et al. | 123/480 X |

*Primary Examiner*—Tony M. Argenbright

*Attorney, Agent, or Firm*—Sughrue, Mion, Zinn, Macpeak and Seas

[57] ABSTRACT

An engine control system in which the sensed intake manifold pressure is initially utilized as the atmospheric pressure, before engine rotation, and is thereafter calculated or updated on the basis of the throttle opening and engine revolution values falling within a detection zone for predetermined time.

8 Claims, 6 Drawing Sheets

ATMOSPHERIC PRESSURE DETECTING DEVICE FOR ENGINE CONTROL

BACKGROUND OF THE INVENTION

1. Field of the Invention

The present invention relates to an atmospheric pressure detecting device for engine control capable of detecting an atmospheric pressure without using an atmospheric pressure sensor.

2. Discussion of Background

Heretofore, operational characteristic quantities for an engine were electronically controlled on the basis of parameters such as an engine revolution speed, a pressure in the intake manifold, a degree of opening of a throttle valve, an atmospheric pressure and so on. A pressure in the intake manifold contiguous to the intake air passage which is at the downstream side of a throttle valve which is operated in association with an accelerator pedal to limit a quantity of intake air to the engine is detected as a value of the absolute pressure by a pressure sensor. An atmospheric pressure is detected by an atmospheric pressure sensor provided separate from the pressure sensor.

Thus, the conventional atmospheric pressure detecting device has a disadvantage of high manufacturing cost because the atmospheric pressure sensor is required in addition to the pressure sensor.

SUMMARY OF THE INVENTION

It is an object of the present invention to provide an atmospheric pressure detecting device for engine control capable of detecting accurately an atmospheric pressure without using an atmospheric pressure sensor and manufactured at low manufacturing cost.

In accordance with the present invention, there is provided an atmospheric pressure detecting device for engine control which comprises a throttle valve sensor for detecting a degree of opening of a throttle valve for limiting a quantity of intake air to an engine, a pressure sensor for detecting a pressure in an air intake manifold, as a value of the absolute pressure, contiguous to an intake air passage at the downstream side of the throttle valve, an engine revolution speed detecting means for detecting a revolution speed of the engine, a cranking detection means for detecting the actuation of a starter for driving the engine, a pressure change detecting means for detecting that a change of pressure detected by the pressure sensor is less than a predetermined level in a predetermined period during a time from power supply to the detection of the actuation of the starter by the cranking detection means, a timer means which receives a signal corresponding to a degree of opening of the throttle valve from the throttle sensor and a signal corresponding to the engine revolution speed from the engine revolution detecting means so as to detect that a time period in which the signal values continuously fall in an atmospheric pressure detection zone, which is determined by the degree of opening of the throttle valve and the engine revolution speed by which a pressure loss in the intake air passage is rendered to be a specified value or less, reaches a predetermined value, and a processing unit which generates a signal of pressure of the pressure sensor as a detected atmospheric pressure value when the processing unit receives a detection signal from the pressure change detecting means, and generates a signal obtained by adding a set value to a signal of pressure from the pressure sensor as a detected atmospheric pressure value when the processing unit receives a detection signal from the timer means.

BRIEF DESCRIPTION OF DRAWINGS:

A more complete appreciation of the invention and many of the attendent advantages thereof will be readily obtained as the same becomes better understood by reference to the following detailed description when considered in connection with the accompanying drawings, wherein.

DETAILED DESCRIPTION OF PREFERRED EMBODIMENTS

Preferred embodiments of the atmospheric pressure detecting device of the present invention will be described with reference to the drawings.

Figure 1:
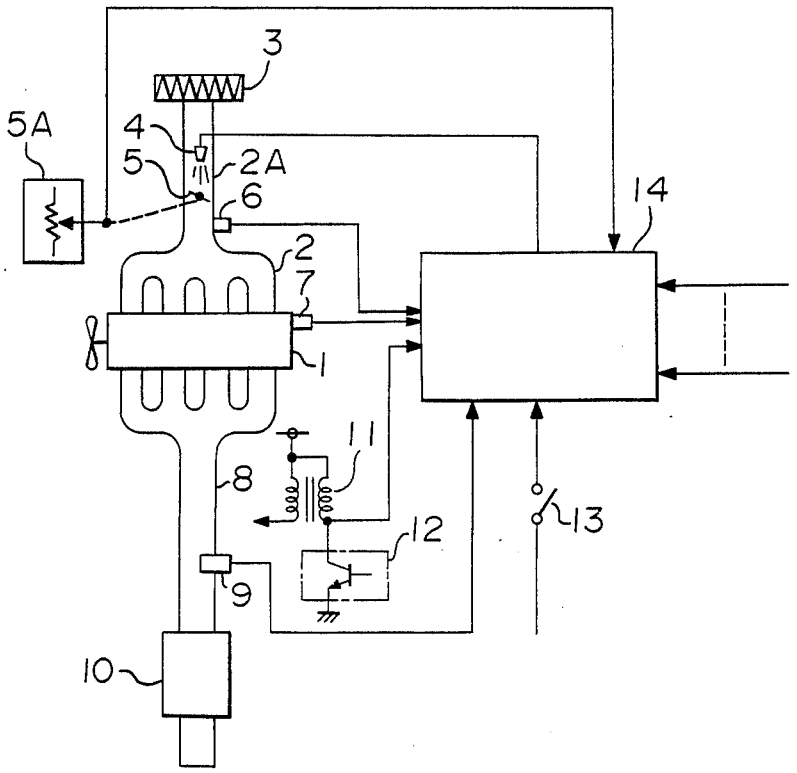
FIG. 1 is a diagram showing an embodiment of the atmospheric pressure detecting device for engine control according to the present invention.

FIG. 1 shows an embodiment of the present invention. In FIG. 1, a reference numeral 1 designates an engine mounted on an automobile; a numeral 2 designates an intake manifold of the engine 1; a numeral 2A designates an intake air pipe main body connected to an upstream port of the intake manifold 2 and forming an intake air pipe along with the intake manifold 2; a numeral 3 designates an air cleaner placed at an inlet port of the intake air pipe main body 2A; and a numeral 4 designate an injector to supply fuel in the intake air pipe main body 2A.

A numeral 5 designates a throttle valve provided in the intake air pipe main body 2A to adjust a degree of opening for the intake air passage so that an amount of air to the engine 1 is controlled; a numeral 5A designates a throttle sensor of a type such as a potentiometer type which operates in association with the throttle valve and produces an analogue voltage in response to the degree of opening of the throttle valve 5; and a numeral 6 designates a pressure sensor which is provided in the intake air pipe main body 2A at the downstream side of the throttle valve 5 to detect a pressure P in the intake manifold as a value of the absolute pressure and produces a signal of pressure having a magnitude corresponding to a detected pressure.

A numeral 7 designates a cooling water temperature sensor to detect a temperature of cooling water WT for the engine 1; a numeral 8 designates an exhaust manifold in the engine 1; a numeral 9 designates an air/fuel ratio sensor to detect a concentration of oxygen in exhaust gas blowing in the exhaust manifold 8; a numeral 10 designates a three-way component catalyst converter for purifying the exhaust gas; a numeral 11 designates an ignition coil for supplying a high voltage to an ignition plug (not shown) of the engine 1; and a numeral 12 designates an igniter to turn on or off the ignition coil 11. A numeral 13 designates a cranking switch which performs ON-OFF operations to thereby turn on or off a starter (not shown) for driving the engine 1 in order to start it and generates ON-OFF signals.

A numeral 14 designates a control device which is adapted to receive signals indicating various parameters obtained by detecting conditions in the engine 1 and other signals such as a battery voltage $V_B$ to perform various determination and calculations on the basis of the parameters and previously determined data, whereby a quantity of fuel to be injected and an atmospheric pressure value are calculated to thereby perform control of the engine.

Figure 2:
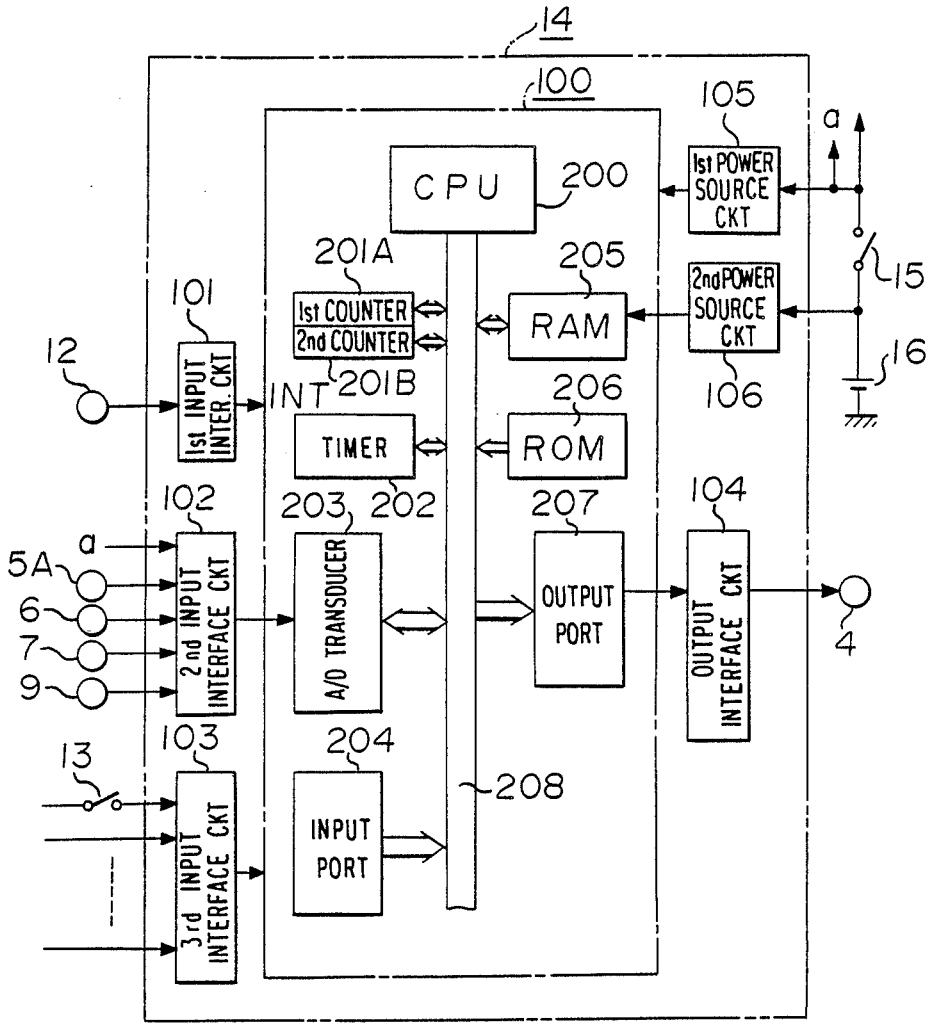
FIG. 2 is a block diagram showing an embodiment of the control device shown in FIG. 1.
Figure 3:
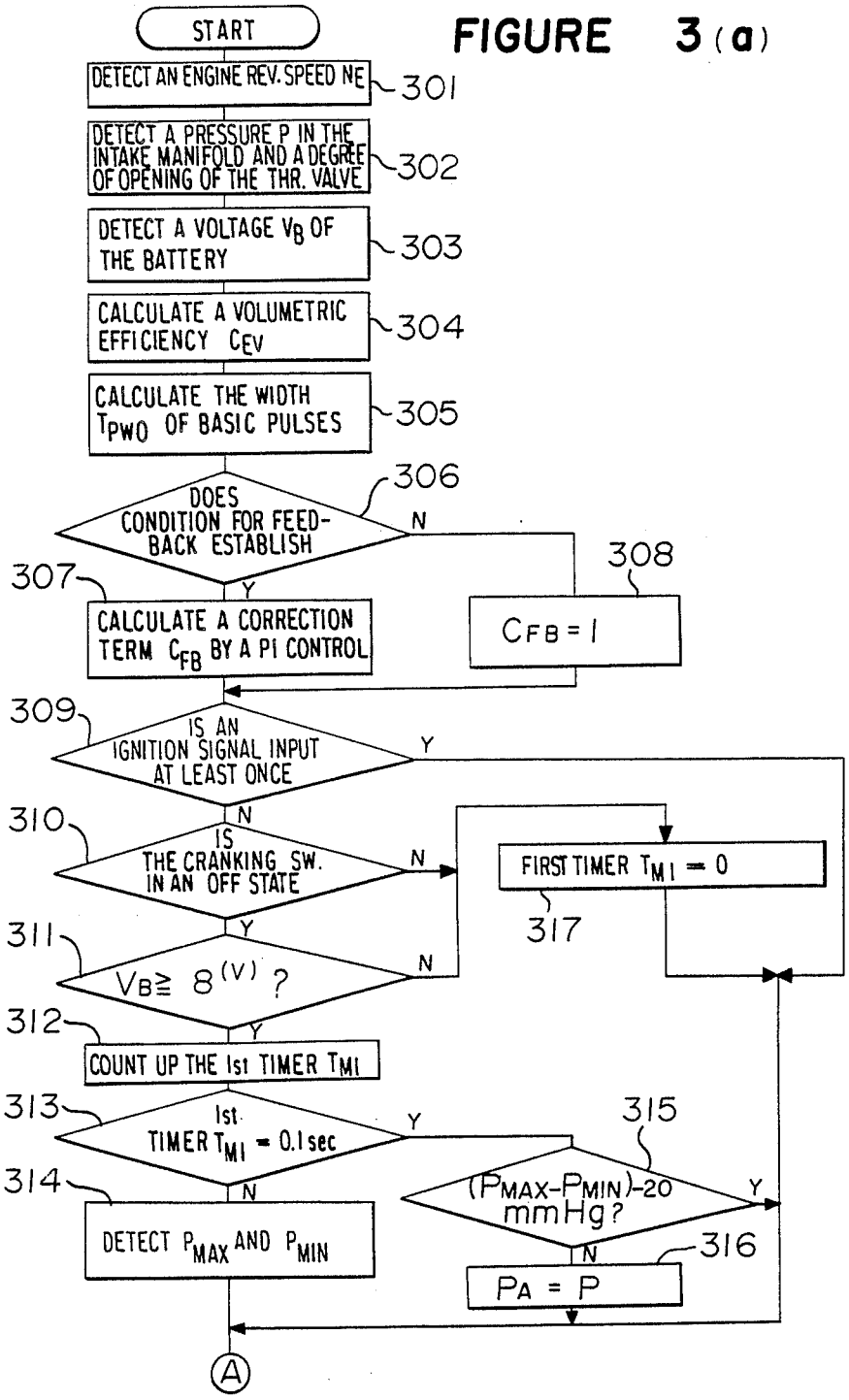
FIGS. 3(*a*) and 3(*b*) show a flow chart showing the operation of a CPU in the control device.
Figure 3:
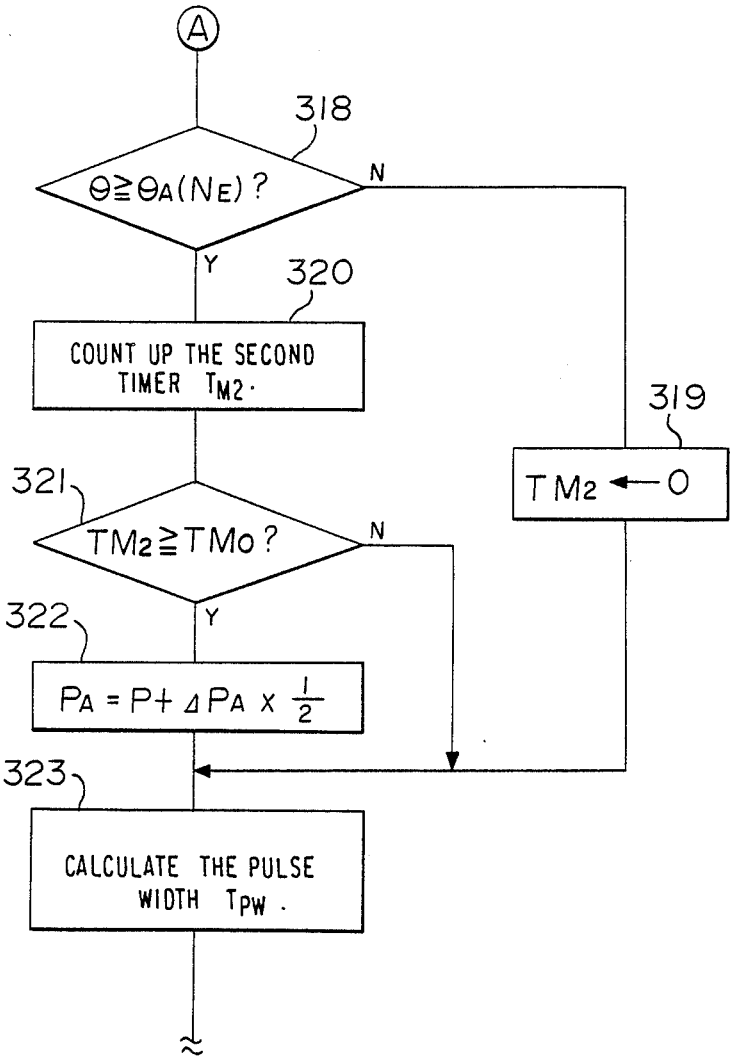

The internal construction of the control device 14 will be described with reference to FIGS. 2 and 3. In FIG. 2, a numeral 100 designates a microcomputer which comprises a CPU 200 to execute a flow of steps as shown in FIG. 3, first and second counters 201A, 202B which function as first and second timers, a timer 202 to measure a period of revolution of the engine 1, an A/D transducer 203 for transforming an analogue signal into a digital signal, an input port 204 to receive for transmission digital signals, a non-volatile RAM 205 which functions as a work memory, an ROM 206 which stores the flow of steps as shown in FIG. 3 in a form of program and various data for calculations and determination, an output port 207 to generate a signal such as a signal of a fuel injection quantity obtained by calculation, and a common bus 208 for connecting the above-mentioned structural elements.

The control device 14 is provided with a first input interface circuit 101 which is connected to the junction of a primary side coil terminal of the ignition coil 11 and the collector of a switching transistor for the igniter 12, and supplies an ignition signal for detecting, for instance, an engine revolution number $N_E$ to the microcomputer 100, a second input interface circuit 102 to input analogue output signals from the throttle sensor 5A, the pressure sensor 6, the cooling water sensor 7, the air-fuel ratio sensor 9 and a battery 16 to which a key switch is connected to the A/D transducer 203, a third input interface circuit 103 to receive ON-OFF signals of the cranking switch 13 and other signals, an output interface circuit 104 connected between the output port 207 and the injector 4, a first power source circuit 105 which is connected to the positive side of the battery 16, whose negative terminal is grounded, through the key switch 15 to thereby feed power to the microcomputer 100, and a second power source circuit 106 connected to the positive side of the battery 16 to thereby supply power to the RAM 205.

Figure 4:
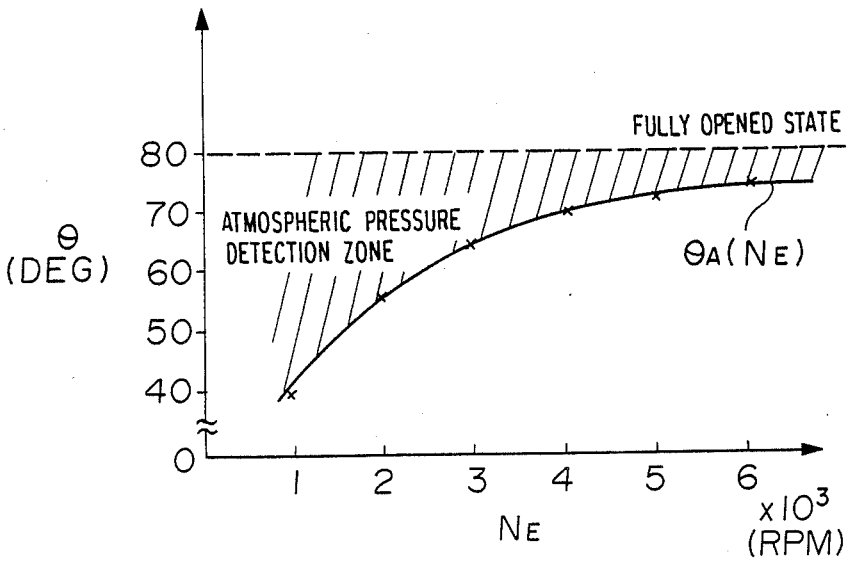
FIG. 4 is a diagram showing an atmospheric pressure detection zone.

FIG. 4 is a diagram showing by hatching a range of atmospheric pressure detection zone wherein the abscissa represents engine revolution speed $N_E$ and the ordinate represents throttle-opening degrees $\theta$. The lower limit values $\theta_A$ ($N_E$) of the atmospheric pressure detection zone are indicated in a relation of the degree of opening of the throttle valve to the engine revolution speed $N_E$. As the engine revolution speed $N_E$ increases, the degree of opening of the throttle valve $\theta$ takes greater values. The data of the lower limit values are previously stored in a form of map in the ROM 206 in a relation of the values of the degree of opening of the throttle valve corresponding to the engine revolution speed $N_E$. The atmospheric pressure detection zone lies between upper limit values obtained when the throttle valve 5 is in a fully opened state, for instance, when it is opened 80° and the lower limit values $\theta_A$ ($N_E$) of the atmospheric pressure detection zone. In such zone, pressure loss becomes small. Namely, the pressure loss in the intake air passage at the downstream side of the throttle valve 5 is lower than $\Delta P_A$ (for instance, $\Delta P_A$ is 20 mmHg) as shown in FIG. 5.

Figure 5:
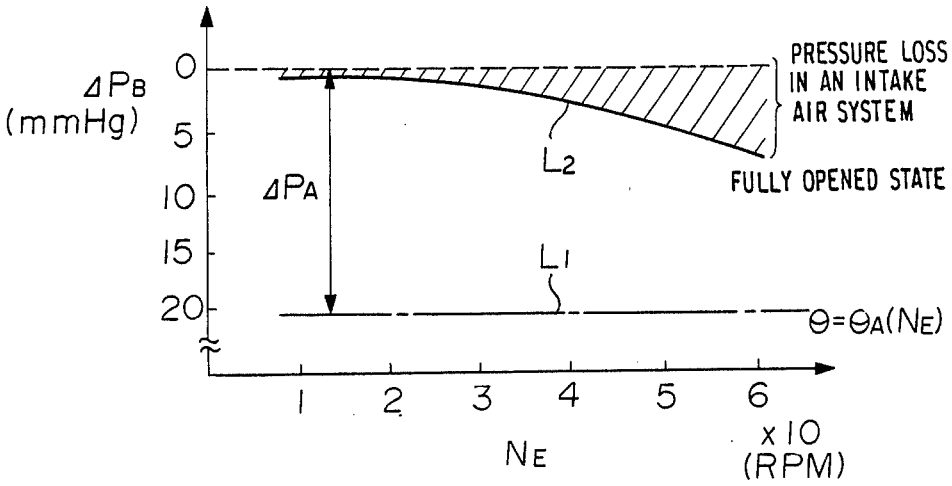
FIG. 5 is a diagram showing the relation of engine revolution speed and degree of opening of the throttle valve as a parameter.

In FIG. 5 showing pressure loss in the intake air system, the abscissa represents engine revolution speed $N_E$ and the ordinate represents pressure loss $\Delta P_B$ in the intake air system. When the pressure loss $\Delta P_B$ is 0, the pressure P in the intake manifold coincides with the atmospheric pressure. When a degree $\theta$ of opening of the throttle valve lies on the curve indicating the lower limit values $\theta_A$ ($N_E$) of the atmospheric pressure detection zone, the pressure loss can be represented by a linear line $L_1$, namely, $\Delta P_B = \Delta P_A$, i.e. the pressure loss is constant. The value of $\Delta P_A$ is previously stored in the ROM 206 as a set value ($\Delta P_A \times \frac{1}{2}$) for compensating the component of pressure loss in the intake air passage at the downstream side of the throttle valve 5. When the throttle valve is in a fully opened state, the pressure loss $\Delta P_B$ increases from a value of nearly zero, as the engine revolution speed $N_E$ increases to thereby closely come to the pressure loss $\Delta P_A$ as shown by a curved line $L_2$. When the throttle valve is opened so as to correspond to the engine revolution speed in the atmospheric pressure detection zone, the values of the pressure loss lies between the linear line $L_1$ and the curved line $L_2$.

The operation executed by the CPU 200 in the microcomputer 100 will be described.

When the key switch 15 is turned on, a voltage is applied to the first power source circuit 105 by means of the battery 16. The first power source circuit 105 supplies a power of a fixed voltage to the microcomputer 100, whereby the control device 14 is actuated. At first, initialization is performed. For instance, the first and second timers are reset to 0, i.e. the first and second counters 201A, 201B are reset to 0, whereby an interrupting operation is effected every predetermined time, and a flow of an interruption routine as shown in FIG. 3 is executed for each predetermined time.

At Step 301, a revolution number $N_E$ of the engine 1 is calculated on the basis of the data measured by the timer 202 which measures a the period of revolution of the engine, and the calculated value of the revolution number $N_E$ is stored in the RAM 205. The timer 202 measures a time from the (m−1)th ignition to the m th ignition by receiving an ignition signal produced when the igniter 12 is changed from ON to OFF through the first input interface circuit 101. The measured value is stored in the RAM 205 by a separate routine.

At Step 302, a signal of pressure indicative of a pressure P in the intake manifold is read from the pressure sensor 6 through the second input interface circuit 102 and the A/D transducer 203. Further, a signal indicative of the degree $\theta$ of opening of the throttle valve is read by means of the throttle sensor 5A through the second input interface circuit 102 and the A/D transducer 203, and the values thus respectively read are stored in the RAM 205.

At Step 303, a voltage $V_B$ in the battery 16 is read as a value changed into a digital value and the read value is stored in the RAM 205 in the same manner as Step 302.

At Step 304, the volumetric efficiency $C_{EV}$ of the engine which is determined by the pressure P in the intake manifold and the engine revolution speed $N_E$ is calculated. Then, the width $T_{PWO}$ of a basic pulse of fuel injection quantity is calculated by using a formula $T_{PWO}$=K (coefficient)×P×$C_{EV}$ at Step 305. At Step 306, determination is made as to whether or not there is established condition for feeding-back an air-fuel ratio from the fact that whether or not the output signal of the air-fuel ratio sensor 9 changes in a predetermined time, or the level of the temperature WT of cooling water detected by the cooling water temperature sensor 7 changes.

When the condition of the feed-back is established at Step 306, calculation of a feed-back correction term $C_{FB}$ in the fuel injection time is executed by using a PI control in response to the output of the air-fuel ratio sensor 9 at Step 307.

On the other hand, when the condition of the feed-back is not established, the correction term $C_{FB}$ is set to be 1 at Step 308.

After Step 307 or Step 308, determination is made whether or not an ignition signal is input at least once from the igniter 12. When NO, Step 310 is taken. At Step 310, determination is made as to whether or not the cranking switch 13 is ON or OFF (the signals of the cranking switch 13 are input through the third input interface circuit 103). When the cranking switch 13 is in an off state, a battery voltage $V_B$ is read from the RAM 205 to determine whether or not the magnitude of the voltage $V_B$ of the battery is 8 volts or more at Step 311. When YES, the number of count in the first counter 201A is increased to thereby increase a time in the first timer $TM_1$ at Step 312. At Step 313, determination is made as to whether or not the value in the first timer $TM_1$ becomes 0.1 second, i.e. a value counted by the first counter 201A becomes a predetermined value. When time in the first time $TM_1$ does not reach 0.1 second, a signal of pressure Which represents a pressure P in the intake manifold is read from the RAM 205 to detect the maximum value $P_{MAX}$ and the minimum value $P_{MIN}$ at Step 314. Then, the detected values are stored in the RAM 205.

At Step 313, when judgement is so made that 0.1 second have passed in the first timer $TM_1$, signals of pressure representing the maximum value $P_{MAX}$ and the minimum value $P_{MIN}$ in pressure P in the intake manifold are read from the RAM to determine whether or not a component of change in pressure ΔP between the maximum and minimum values ($=P_{MAX}-P_{MIN}$) is beyond a predetermined pressure value (for instance) 20 mmHg at Step 315. When the component of change in pressure ΔP is lower than 20 mmHg, Step 316 is taken, where a signal representing a pressure P in the intake manifold is read from the pressure sensor 6 and the signal is output as a detected atmospheric pressure value representing an atmospheric pressure $P_A$, the detected value being stored in the RAM 205.

When judgement is so made that the cranking switch 13 is in an ON state at Step 310, or when the magnitude of the voltage $V_B$ of the battery read from the RAM 205 is less then 8 volts at Step 311, then, the first counter 201A is reset to 0 at Step 317.

When judgement is so made that the ignition signal is input at least once at Step 309, or the operation of Step 314 is finished, or when the operation of Step 317 is finished, or when judgement is so made that the component of change in pressure ΔP exceeds 20 mmHg at Step 315, or when the operation of Step 316 is finished, Step 318 is taken. At Step 318, determination is made as to whether or not a degree θ of opening of the throttle valve represented by a signal on the degree of opening of the throttle valve taken from the RAM 205 is higher than the lower limit value $\theta_A$ ($N_E$) of the atmospheric pressure detection zone taken from the ROM 206. Namely, determination is made as to whether or not the degree θ of opening of the throttle valve and the engine revolution speed $N_E$ detected, fall in the atmospheric pressure detection zone. When $\theta<\theta_A$ ($N_E$), i.e. values of the degree of opening of the throttle valve corresponding to an engine revolution speed are out of the atmospheric pressure detection zone, the second counter 201B is reset to zero, whereby the value of the second timer $TM_2$ is reset to zero at Step 319. On the other hand, when $\theta\geqq\theta_A$ ($N_E$), i.e. when a degree θ of opening of the throttle valve in relation to an engine revolution number $N_E$ is in the atmospheric pressure detection zone at Step 318, the second counter 201B is counted up to thereby increase the number of the second timer $TM_2$ at Step 320. Then, determination is made as to whether or not the value of the second time $TM_2$ is equal to or higher than a predetermined value $TM_0$ at Step 321.

When the value of the second timer $TM_2$ is equal to or higher than the predetermined value, the judgement that a time in which the values of the degree θ of opening of the throttle valve and the engine revolution number $N_E$ continuously fall in the atmospheric pressure detection zone reaches a predetermined time, is made, and then, sequential step moves from Step 321 to step 322. At Step 322, a value of atmospheric pressure $P_A$, which is determined by the pressure P of the intake manifold and the pressure loss $\Delta P_A$ at the lower limit of the atmospheric pressure detection zone, are operated, and thus obtained value is stored in the RAM 205. In the calculation, a formula $P_A=P+\Delta P_A\times\frac{1}{2}$ is used, wherein a signal of the value of pressure P is read from the RAM 205, and a signal of the set value $\Delta P_A\times\frac{1}{2}$ is read from the ROM 206.

When the operation of Step 319 is finished, or when the value of the second timer $TM_2$ is smaller than the predetermined value $TM_0$ at Step 321, or the operation of Step 322 is finished, Step 323 is taken. At Step 323, the width $T_{PW}$ of pulses of fuel injection quantity is calculated by multiplying the width $T_{PWO}$ of the basic pulse by a feed-back correction term $C_{FB}$, which are read from the RAM 205.

Figure 6:
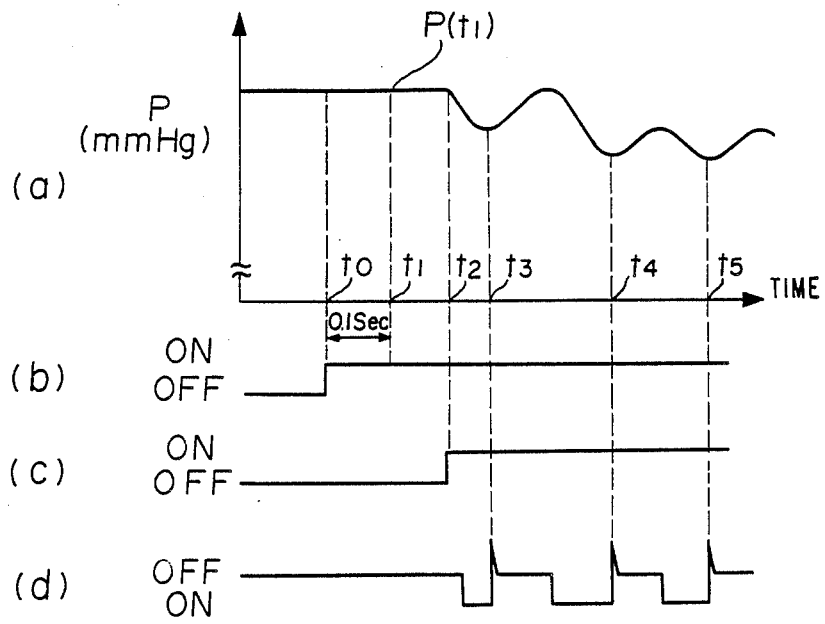
FIGS. 6(*a–d*) and 7(*a–d*) are respectively diagrams showing signals at several parts in the control device.
Figure 7:
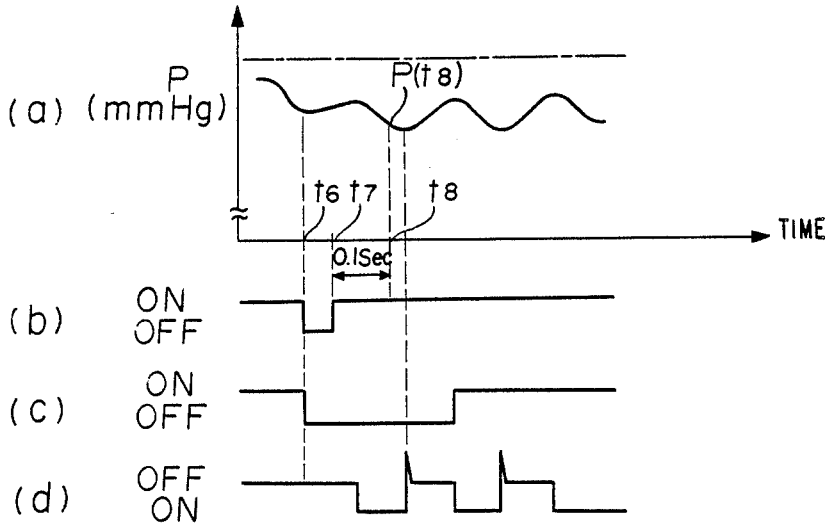

FIGS. 6 and 7 are respectively time charts wherein the abscissa represents time and the ordinate represents the magnitude of pressure P in the intake manifold at the part (a), the ON-OFF state of a signal from the key switch 15 at the part (b), the ON-OFF state of a signal from the cranking switch 13 at the part (c), and the ON-OFF state of a signal from the igniter 12 at the part (d).

FIG. 6 shows that a signal representing an atmospheric pressure $P_A$ is read as a detected value of atmospheric pressure from the pressure sensor 6 under the condition without any erroneous operation. Namely, the key switch 15 is turned on at a time point $t_0$; the cranking switch 13 is in an OFF state during a time from the time point $t_0$ to a timer point $t_1$ which is 0.1 second after the time point $t_0$; and the ignition signal is never received from the igniter 12. Accordingly, a quantity of change in pressure P in the intake manifold in this time period is small such as less than 20 mmHg. In this case, an atmospheric pressure $P_A$ at a point $P(t_1)$ corresponding to the time point $t_1$ is detected. At the time of detection of the atmospheric pressure $P_A$, the engine 1 is not yet rotated; air is not sucked, and no pressure loss is caused. Accordingly, error in detecting the atmospheric pressure is extremely small. At a time point $t_2$ following the time point $t_1$, the cranking switch 13 is changed from the OFF state to the ON state, and at the same time, the engine 1 is started. After the time point $t_2$, air is intermittently sucked via the air cleaner 3, the intake air pipe 2A and the intake manifold 2, and at each time point $t_3$, $t_4$, $t_5$ . . . , an ignition signal is provided to effect explosion processes so that the engine 1 performs well-known operations. Accordingly, the pressure P in the intake manifold largely changes. Under such condition, if a signal value of pressure from the pressure sensor 6 is taken as a detected value of atmospheric pressure in the case that the change of pressure exceeds 20 mmHg after the time point $t_2$, or the ignition signal is inputted at least once after the time point $t_3$, a detection error will be large. Accordingly, it is necessary to correct the signal of atmospheric pressure by using a set value so that the corrected value is taken as a detected value of atmospheric pressure.

FIG. 7 shows an accidental condition of signal in which a signal from the key switch 15 is temporarily turned off by any cause such as the interruption of service of power and is immediately turned on again. Namely, when the signal from the key switch 15 is changed to OFF at a time point $t_6$ during the revolution of the engine 1, and immediately return to an ON state at a time point $t_7$, the pressure P in the intake manifold is fairly decreased from the atmospheric pressure indicated by one-dotted chain line and shows a large ripple because air intake strokes are successively taken place due to the running-on of the engine 1. In this case, the cranking switch 13 is changed to an OFF state at the time point $t_6$, and also shows the OFF state at a time point $t_8$ which is 0.1 second behind the time point $t_7$. At the time point $t_8$, there has been no ignition signal input. However, since a component of change in pressure P in the intake manifold exceeds 20 mmHg, the pressure P in the intake manifold detected at a point P ($t_8$) corresponding to the time point $t_8$ is not read as a detected value of atmospheric pressure.

In the above-mentioned embodiment, the difference between the maximum value $P_{MAX}$ and the minimum value $P_{MIN}$ of the pressure in the intake manifold is detected and a component of pressure change of the difference is compared with a predetermined pressure. However, instead of the above-mentioned, a component of pressure change which is obtained by sampling the pressure P in the intake manifold at a fixed period may be compared with a predetermined pressure.

The pressure loss $\Delta P_A$ may be changed in response to the engine revolution speed $N_E$ without fixing the value. Further, the data of the lower limit values $\theta_A$ ($N_E$) may be a function in which the engine revolution speed is a variable. In this case, the value $\theta_A$ ($N_E$) is obtainable by a functional calculation.

In the above-mentioned embodiment, the pressure P in the intake manifold is detected by the pressure sensor 6 at Step 316. However, the pressure P of the intake manifold detected at Step 302 is read from the RAM 205 to use it as a detected value of atmospheric pressure.

Thus, in accordance with the present invention, when a change of pressure in the intake manifold is lower than a predetermined value during an OFF state of the cranking switch after power has been supplied from the power source, a signal of pressure from the pressure sensor is read as a detected value of atmospheric pressure, and when the engine is rotated, a detected value of atmospheric pressure is calculated by adding a set value to a signal of pressure in case that the value of the degree of opening of the throttle valve and the engine revolution speed continuously fall in the atmospheric pressure detection zone for a predetermined time. Accordingly, the atmospheric pressure before and after starting the engine can be accurately detected. Further, the construction of the atmospheric pressure detecting device for engine control can be simple because an atmospheric pressure sensor is not required, and therefore the manufacturing cost of the device can be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. An atmospheric pressure detecting device for engine control which comprises:

a throttle valve sensor for detecting a degree of opening of a throttle valve for limiting a quantity of intake air to an engine, a pressure sensor for detecting a pressure in an air intake manifold, as a value of the absolute pressure, contiguous to an intake air passage at the downstream side of said throttle valve, an engine revolution speed detecting means for detecting a revolution speed of the engine, a cranking detection means for detecting the actuation of a starter for driving the engine, a pressure change detecting means for detecting that a change of pressure detected by said pressure sensor is less than a predetermined level in a predetermined period during a time from power supply to the detection of the actuation of the starter by said cranking detection means, a timer means which receives a signal corresponding to a degree of opening of the throttle valve from said throttle sensor and a signal corresponding to the engine revolution speed from said engine revolution speed detecting means so as to detect that a time period in which said signal values continuously fall in an atmospheric pressure detection zone, which is determined by said degree of opening of the throttle valve and said engine revolution speed by which a pressure loss in said intake air passage is rendered to be a specified value or less, reaches a predetermined value, and a processing unit which generates a signal of pressure of said pressure sensor as a detected atmospheric pressure value when the processing unit receives a detection signal from said pressure change detecting means, and generates a signal obtained by adding a set value to a signal of pressure from said pressure sensor as a detected atmospheric pressure value when the processing unit receives a detection signal from said timer means.

2. The atmospheric pressure detecting device according to claim 1, wherein said change of pressure is the difference between the maximum pressure value and the minimum pressure value of the pressure in said air intake manifold.

3. The atmospheric pressure detecting device according to claim 1, wherein said predetermined period during a time from power supply to the detection of the actuation of said starter is determined by a counted value in a first counter.

4. The atmospheric pressure detecting device according to claim 1, wherein said cranking detection means is a cranking switch.

5. The atmospheric pressure detecting device according to claim 1, wherein said atmospheric pressure detecting zone is defined by upper limit values obtained when the throttle valve is in a fully opened state and the lower limit values determined by the degrees of opening of the throttle valve corresponding to the engine revolution speeds.

6. The atmospheric pressure detecting device according to claim 5, wherein said lower limit values are previously stored in a memory device.

7. The atmospheric pressure detecting device according to claim 1, wherein said set value is obtained by multiplying a specified value of a pressure loss by a coefficient.

8. The atmospheric pressure detecting device according to claim 1, wherein said time period in which the signal values from said throttle sensor and said engine revolution detecting means fall in the atmospheric pressure detection zone is determined by a counted value in a second counter.

* * * * *